US011124952B2

(12) United States Patent
Reddekopp

(10) Patent No.: US 11,124,952 B2
(45) Date of Patent: Sep. 21, 2021

(54) VALVE ROD ISOLATION APPARATUS AND ASSEMBLY

(71) Applicant: Jacob Wayne Reddekopp, Warman (CA)

(72) Inventor: Jacob Wayne Reddekopp, Warman (CA)

( * ) Notice: Subject to any disclaimer, the term of this patent is extended or adjusted under 35 U.S.C. 154(b) by 0 days.

(21) Appl. No.: 16/877,782

(22) Filed: May 19, 2020

(65) Prior Publication Data

US 2020/0378095 A1 Dec. 3, 2020

(30) Foreign Application Priority Data

May 30, 2019 (CA) ..... CA 3044765

(51) Int. Cl.
*F16L 5/00* (2006.01)
*E03B 7/07* (2006.01)
*E03B 9/18* (2006.01)

(52) U.S. Cl.
CPC . *E03B 7/07* (2013.01); *E03B 9/18* (2013.01)

(58) Field of Classification Search
CPC ... E03B 7/07; E03B 9/04; E03B 9/025; E03B 9/08; E03B 9/12; E03B 9/18
See application file for complete search history.

(56) References Cited

U.S. PATENT DOCUMENTS 2,176,399 A * 10/1939 Garrett ..... F16K 41/02 137/368
2,688,976 A * 9/1954 Baker ..... E03B 7/10 137/284
3,494,373 A * 2/1970 Horak ..... E03B 9/08 137/217
3,943,963 A * 3/1976 Papacek ..... E03B 9/02 137/283
3,983,896 A 10/1976 Harrington
5,299,884 A * 4/1994 Westhoff ..... E02D 29/149 404/25
7,117,883 B1 * 10/2006 Vitalo ..... E03B 9/08 137/366
2006/0254649 A1 * 11/2006 Cotugno ..... E03B 9/08 137/365

* cited by examiner

*Primary Examiner* — Reinaldo Sanchez-Medina
(74) *Attorney, Agent, or Firm* — Gordon & Jacobson, P.C.

(57) ABSTRACT

A valve rod isolation apparatus for reducing valve rod exposure to moisture and debris in a subsurface environment, wherein the valve rod is housed within an isolation sleeve that is sealed top and bottom.

24 Claims, 9 Drawing Sheets

VALVE ROD ISOLATION APPARATUS AND ASSEMBLY

CROSS-REFERENCE TO RELATED APPLICATION(S)

The present application claims priority from Canadian Patent Application Serial No. 3,044,765, filed on May 30, 2019, entitled "VALVE ROD ISOLATION APPARATUS AND ASSEMBLY," herein incorporated by reference in its entirety.

BACKGROUND

1. Field

The present application relates to subsurface valve actuation assemblies, and more particularly to means for isolating valve rods from moisture and debris and avoiding or reducing ice build-up around the valve rod.

2. State of the Art

It is known in the art of utility infrastructure such as water and sewage lines to employ underground water supply and waste removal lines, and such lines are commonly provided with valves to selectively open and close the lines. As the lines are normally positioned several feet below the ground surface, various means have been developed to access the subsurface valves.

In a conventional arrangement, a vertical access hole is provided extending from the surface to a level adjacent the valve, and the hole is in some arrangements lined with a valve box which reduces the risk of wall collapse into the hole. The hole (with or without a valve box) thus exposes the valve, and a valve rod extends vertically through the hole and is mounted on the valve by means of a bottom nut. The top of the valve rod is provided with a top nut, configured for engagement by a valve wrench. In operation, a surface cover is removed and the valve wrench is lowered into the hole to engage the top nut, and the valve wrench is used to rotate the valve rod which in turn actuates the valve to open or close it.

However, it has been found that even the presence of the valve box is sometimes insufficient to block ingress of moisture and debris into the hole, where such moisture and debris come into contact with the valve rod. While debris can compact around the valve rod and negatively impact the ability to rotate the valve rod, moisture in colder climates can result in ice build-up around the valve rod. Such ice build-up has been known in some cases to fill the hole completely. When ice accumulates in the hole around the valve rod, a common solution is to bring in a steam truck to apply steam to the accumulation to free the valve rod for rotation, but this is a costly and time-consuming process. As a city may have thousands of such valve rods, it is clear that the conventional solution is undesirable.

Various "frost-free" valve actuation assemblies have been proposed in the art. For example, U.S. Pat. No. 3,983,896 to Harrington discloses an "anti-freeze device" wherein a portion of the valve rod is provided with an insulating sleeve. However, the arrangement requires an above-ground portion, and it employs O-rings for sealing which are well known to fail in colder climates.

What is needed, therefore, is a simple and robust mechanism that can isolate a valve rod from ambient conditions while allowing operation during cold-weather conditions.

SUMMARY

According to a first broad aspect of the present application, there is provided an isolation apparatus for a subsurface valve rod, the valve rod configured to actuate a subsurface valve, the valve accessible by a hole extending downwardly from ground level toward the valve within which hole the valve rod is located, the valve rod comprising a top end and a bottom end, the bottom end of the valve rod connected to the valve via a bottom nut and the top end of the valve rod configured for engagement with a valve wrench via a top nut for rotation of the valve rod to actuate the valve, the isolation apparatus comprising: an isolation sleeve; an upper seal retained in an upper portion of the isolation sleeve; a lower seal retained in a lower portion of the isolation sleeve; and the upper and lower seals provided with apertures therethrough, the apertures configured for receipt of the valve rod therein; such that when the valve rod is received through the apertures the top end of the valve rod extends above the upper seal and the bottom end of the valve rod extends below the lower seal; such that when the isolation apparatus is installed on the valve rod and the valve rod is connected to the valve via the bottom nut the isolation sleeve and the lower seal abut the bottom nut; and such that when the isolation apparatus is installed on the valve rod and the valve rod is connected to the top nut the isolation sleeve and the upper seal abut the top nut.

In some exemplary embodiments of the first aspect of the present application, the apparatus further comprises a spacer located between and in contact with the upper and lower seals. The spacer may be composed of high-density polyethylene or any other suitable material. The upper and lower seals are preferably composed of polyethylene, and in some exemplary embodiments the upper and lower seals are retained within the isolation sleeve by slip-fit engagement with an inner surface of the isolation sleeve; the slip-fit engagement may be achieved by at least one barb on outer surfaces of each of the upper and lower seals. The isolation sleeve is preferably composed of a material selected from the group consisting of polyvinyl chloride and high-density polyethylene. The subsurface valve may be on a water line or a sewer line.

According to a second broad aspect of the present application, there is provided an actuation assembly for a subsurface valve, the valve accessible by a hole extending from ground level, the assembly comprising: a valve rod located within the hole and comprising a top end and a bottom end, the top end of the valve rod connected to a top nut, the top nut configured for engagement by a valve wrench, the bottom end of the valve rod connected to a bottom nut, the bottom nut connected to the valve, such that rotation of the valve rod by the valve wrench actuates the valve; an isolation sleeve; an upper seal retained in an upper portion of the isolation sleeve; a lower seal retained in a lower portion of the isolation sleeve; the upper and lower seals provided with apertures therethrough, the valve rod received through the apertures, the top end of the valve rod extending above the upper seal and the bottom end of the valve rod extending below the lower seal; the isolation sleeve and the lower seal abutting the bottom nut; and the isolation sleeve and the upper seal abutting the top nut.

In some exemplary embodiments of the second aspect of the present application, the assembly further comprises a spacer located between and in contact with the upper and lower seals. The spacer may be composed of high-density polyethylene or any other suitable material. The upper and lower seals are preferably composed of polyethylene, and in some exemplary embodiments the upper and lower seals are retained within the isolation sleeve by slip-fit engagement with an inner surface of the isolation sleeve; the slip-fit engagement may be achieved by at least one barb on outer surfaces of each of the upper and lower seals. The isolation sleeve is preferably composed of a material selected from the group consisting of polyvinyl chloride and high-density polyethylene. The subsurface valve may be on a water line or a sewer line.

According to a third broad aspect of the present application, there is provided an actuation assembly for a subsurface valve, the valve accessible by a hole extending from ground level, the assembly comprising: a valve rod located within the hole and comprising a top end and a bottom end, the top end of the valve rod configured for engagement by a valve wrench, the bottom end of the valve rod connected to a bottom nut, the bottom nut connected to the valve, such that rotation of the valve rod by the valve wrench actuates the valve; an isolation sleeve; an upper seal retained in an upper portion of the isolation sleeve; a lower seal retained in a lower portion of the isolation sleeve; the upper and lower seals provided with apertures therethrough, the valve rod received through the apertures, the top end of the valve rod extending above the upper seal and the bottom end of the valve rod extending below the lower seal; and the isolation sleeve and the lower seal abutting the bottom nut.

In some exemplary embodiments of the third aspect of the present application, the upper and lower seals are preferably composed of polyethylene, and in some exemplary embodiments the upper and lower seals are retained within the isolation sleeve by slip-fit engagement with an inner surface of the isolation sleeve. The isolation sleeve is preferably composed of a material selected from the group consisting of polyvinyl chloride and high-density polyethylene. The subsurface valve may be on a water line or a sewer line.

A detailed description of exemplary embodiments of the present application is given in the following. It is to be understood, however, that the claims are not to be construed as being limited to these embodiments. The exemplary embodiments are directed to particular applications of the present application, while it will be clear to those skilled in the art that the subject matter of the present application has applicability beyond the exemplary embodiments set forth herein.

BRIEF DESCRIPTION OF THE DRAWINGS

The accompanying drawings illustrate exemplary embodiments of the present application.

Exemplary embodiments will now be described with reference to the accompanying drawings.

DETAILED DESCRIPTION OF THE PREFERRED EMBODIMENTS

Throughout the following description, specific details are set forth in order to provide a more thorough understanding to persons skilled in the art. However, well known elements may not have been shown or described in detail to avoid unnecessarily obscuring the disclosure. The following description of exemplary embodiments is not intended to be exhaustive or to limit the subject matter of the present application to the precise form of any exemplary embodiment. Accordingly, the description and drawings are to be regarded in an illustrative sense, rather than a restrictive sense.

The present application is directed to isolation apparatuses and assemblies to reduce contact of moisture and debris with a valve rod in a hole used for accessing a subsurface valve. Two exemplary embodiments are described herein, but other embodiments will be clear to those skilled in the art based on the within teaching and their own knowledge of the technical field.

Figure 1A:
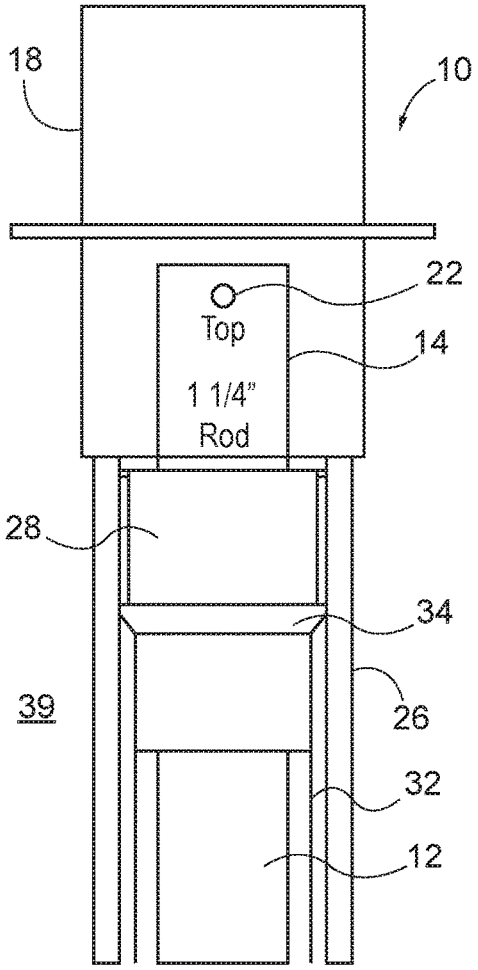
FIG. 1*a* is a side elevation view, partly in section, of the upper portion of an isolation assembly in accordance with a first exemplary embodiment of the present application.
Figure 1B:
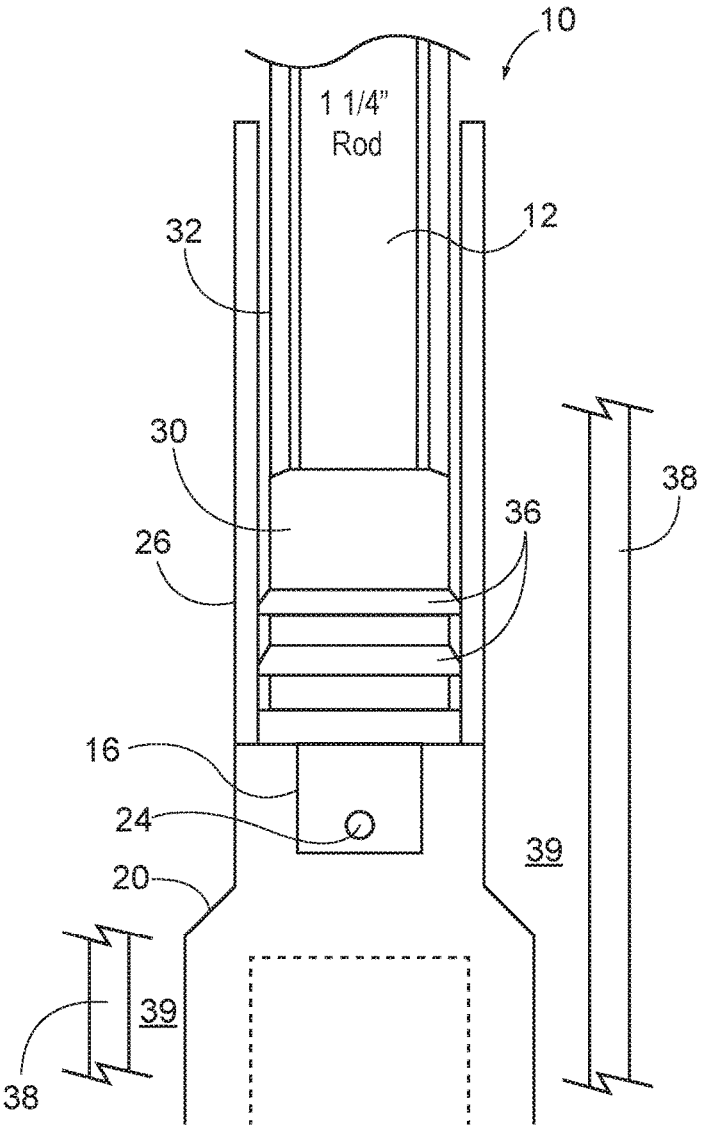
FIG. 1*b* is a side elevation view, partly in section, of the lower portion of the isolation assembly shown in FIG. 1*a*.

Turning to FIGS. 1*a* and 1*b*, a first exemplary embodiment of an isolation assembly 10 is illustrated. FIG. 1*a* shows the upper portion of the assembly 10, while FIG. 1*b* shows the lower portion of the assembly 10. In the illustrated embodiment, a valve rod 12 is vertically oriented within a void space 39 defined by a valve box 38; the valve box 38 is only partially shown in FIGS. 1*a* and 1*b*, but it would fully enclose the hole from surface down to the level of a valve (the valve not shown in this embodiment, but it would be engaged by the bottom nut 20, described below). The valve rod 12 comprises a top end 14 and a bottom end 16, and is preferably composed of hot rolled steel. The top end 14 of the valve rod 12 connects to a top nut 18 (preferably composed of cast iron) in a conventional manner, namely with a pin positioned in a hole (shown as 22), while the bottom end 16 of the valve rod 12 connects to a bottom nut 20 (preferably composed of cast iron) in a conventional manner, namely with a pin positioned in a hole (shown as 24).

The valve rod 12 is housed within a cylindrical isolation sleeve 26, which is preferably composed of polyvinyl chloride or high-density polyethylene. The upper portion of the sleeve 26 is provided with an upper seal 28, which is preferably composed of polyethylene, and the upper seal 28 is pressed into the interior of the sleeve 26 and held in place by a slip-fit or interference-fit engagement of an externally-protruding barb 34 with the inner walls of the sleeve 26. The lower portion of the sleeve 26 is provided with a lower seal 30, which is preferably composed of polyethylene, and the lower seal 30 is pressed into the interior of the sleeve 26 and held in place by a slip-fit or interference-fit engagement of externally-protruding barbs 36 with the inner walls of the sleeve 26. While the seals 28, 30 may remain in position due to the engagement mechanism, a spacer 32 is preferably employed to hold the seals 28, 30 in position at a desired distance apart, which spacer 32 is preferably composed of high-density polyethylene.

Figure 5:
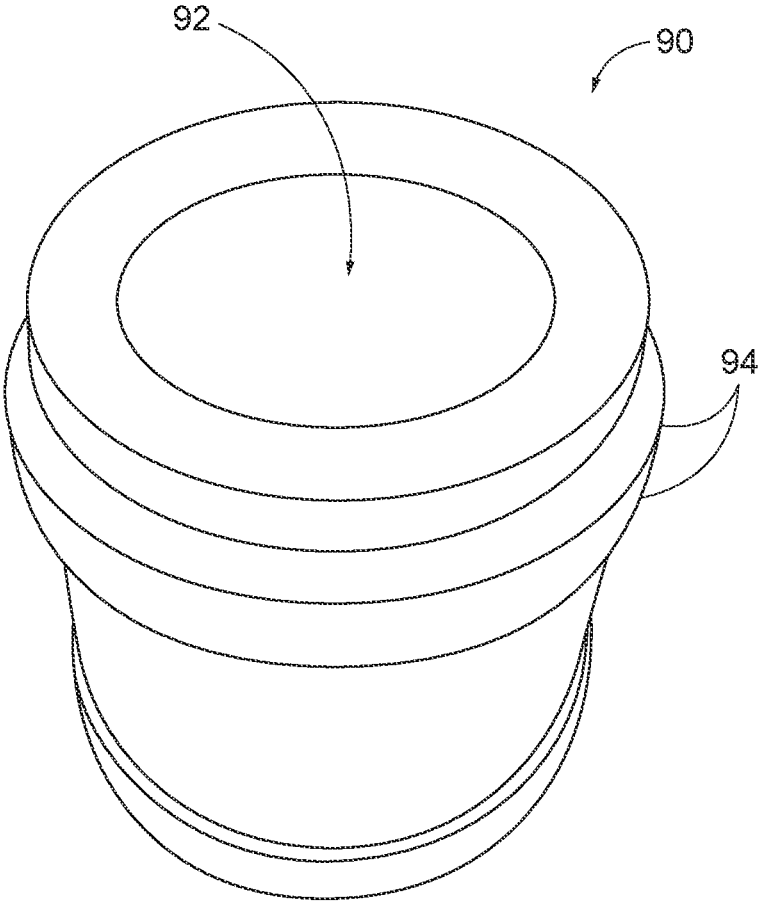
FIG. 5 is a perspective view of an exemplary seal.

As can be seen in FIGS. 1*a* and 1*b*, the valve rod 12 passes through apertures in the seals 28, 30, with a tight fit between the valve rod 12 and the aperture walls to ensure a desirable seal. FIG. 5 shows an exemplary seal 90, with an aperture 90 and barbs 94.

As can be seen in FIG. 1*a*, the top surface of the upper seal 28 is flush with the top end of the isolation sleeve 26, and these surfaces abut the top nut 18 when assembled. Similarly, the bottom surface of the lower seal 30 is flush with the bottom end of the isolation sleeve 26, and these surfaces about the bottom nut 20 when assembled. Combined with the isolation sleeve 26 itself, with or without the spacer 32, these features create an isolative environment around the valve rod 12 and reduce the ability of moisture and debris from contacting the valve rod 12.

Figure 2A:
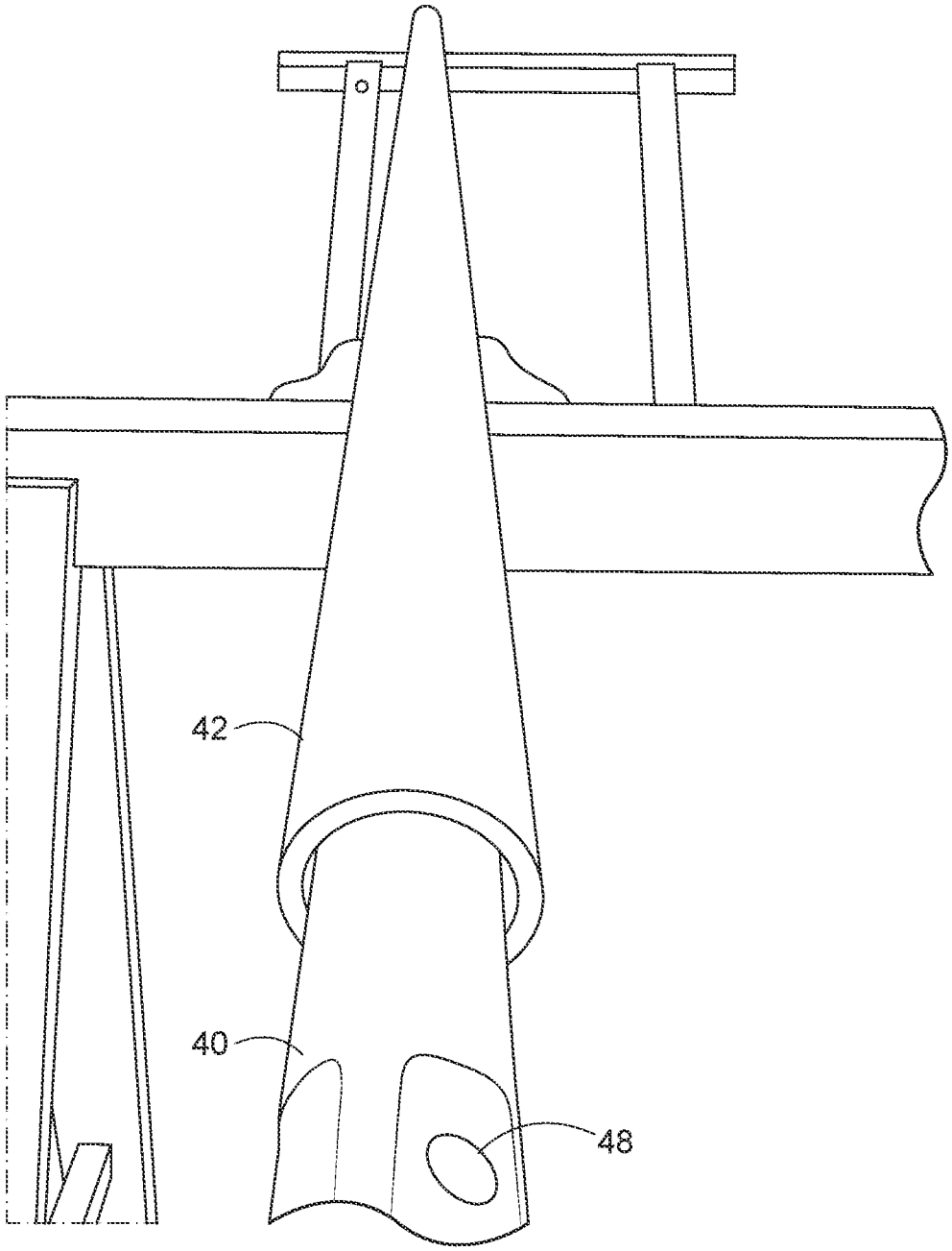
FIG. 2*a* is a perspective view of a valve rod inserted into a spacer.
Figure 2B:
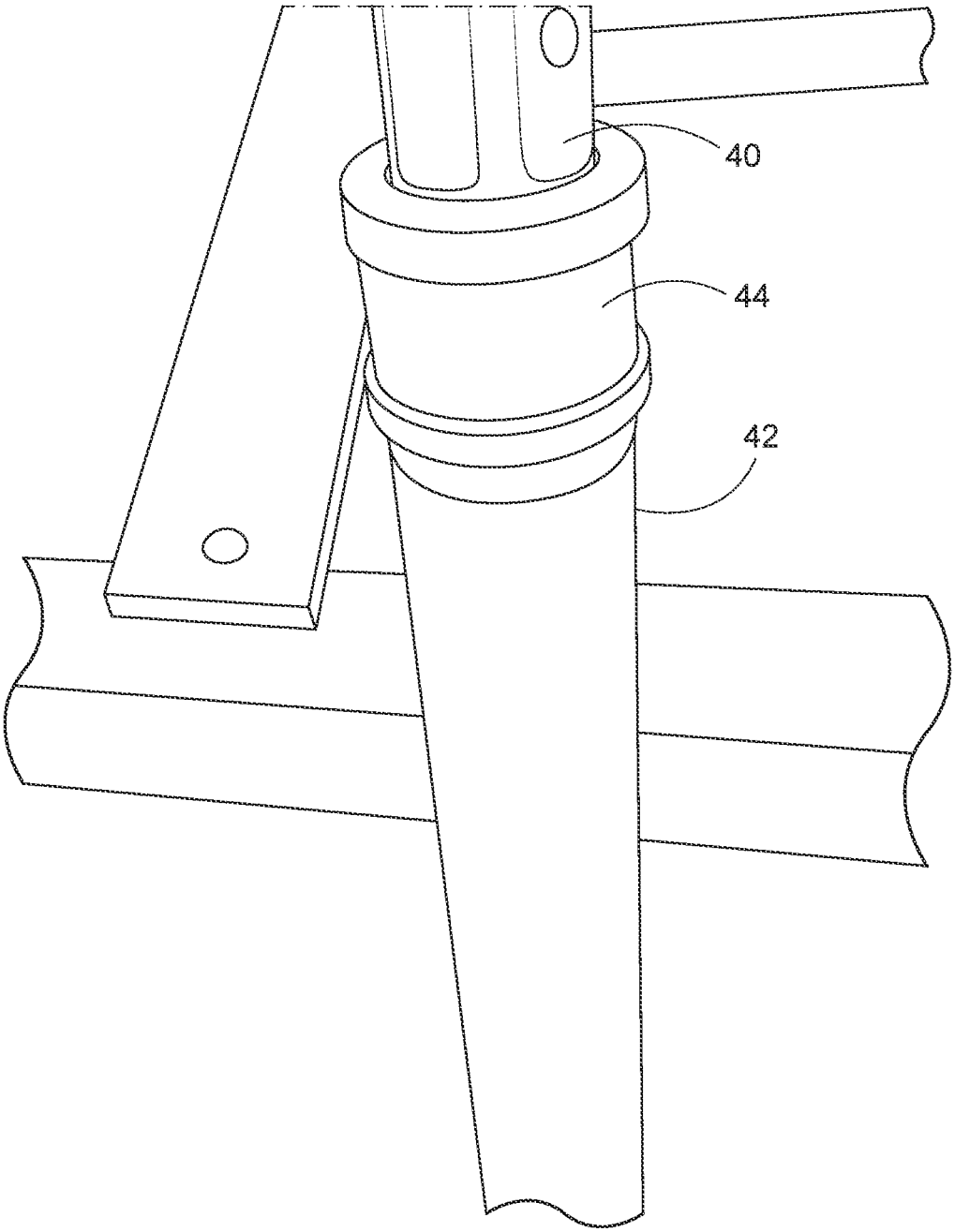
FIG. 2*b* is perspective view of the valve rod of FIG. 2*a* with a seal installed over the rod end.
Figure 2C:
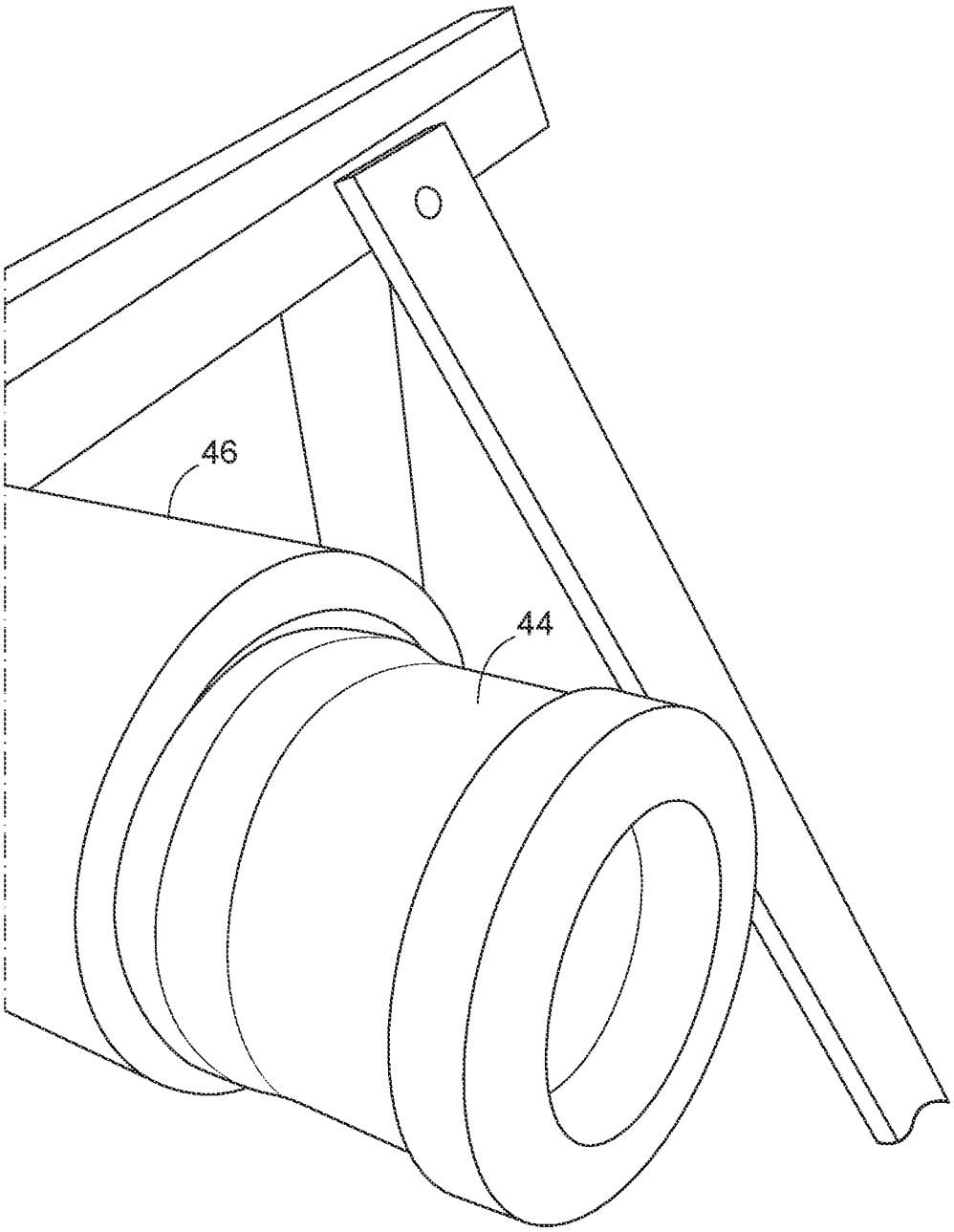
FIG. 2*c* is a perspective view of the valve rod of FIG. 2*a* with the seal being inserted into the isolation sleeve.
Figure 2D:
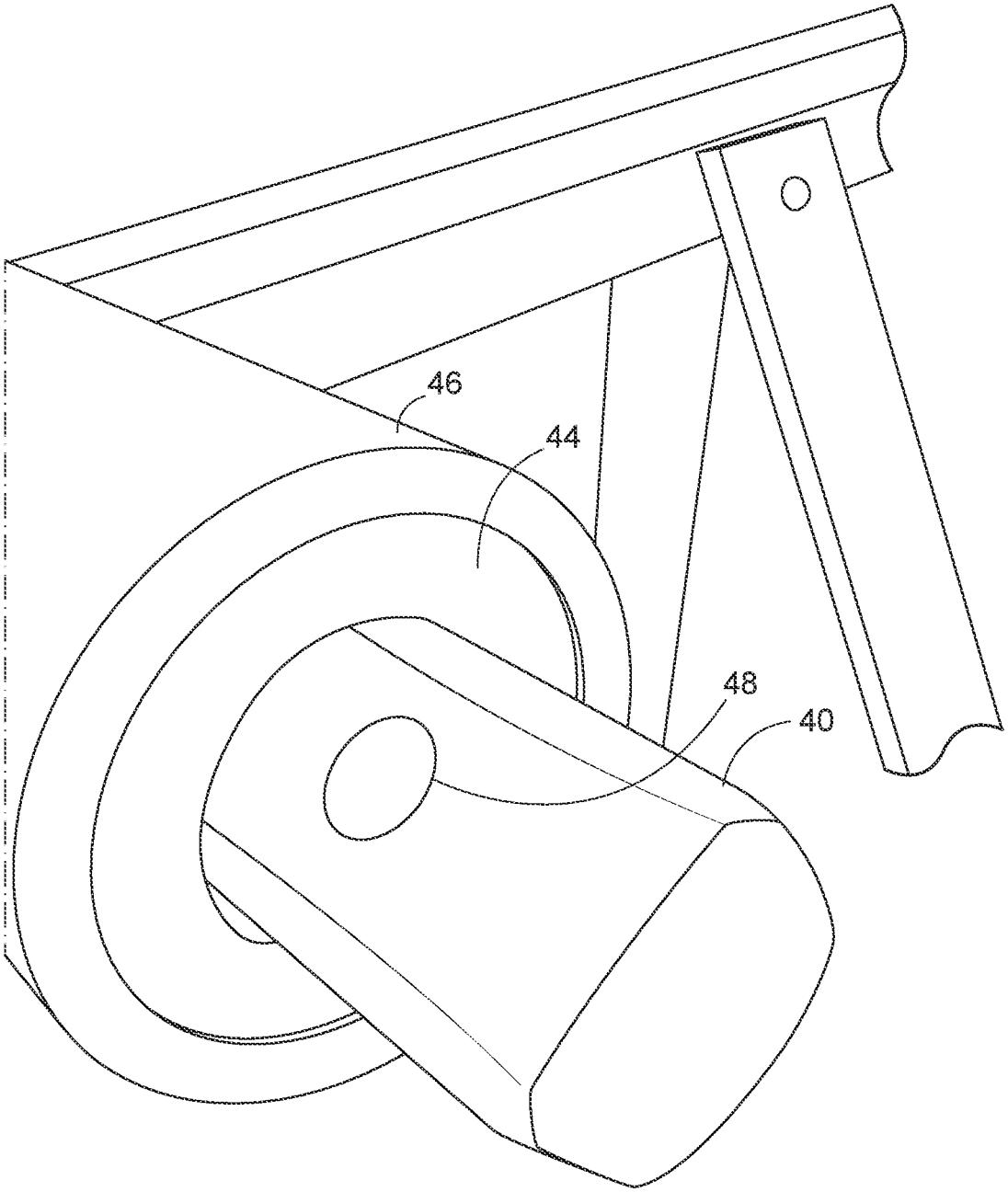
FIG. 2*d* is a perspective view of the valve rod of FIG. 2*a* installed into the isolation sleeve, with the seal flush with the lip of the isolation sleeve.
Figure 3A:
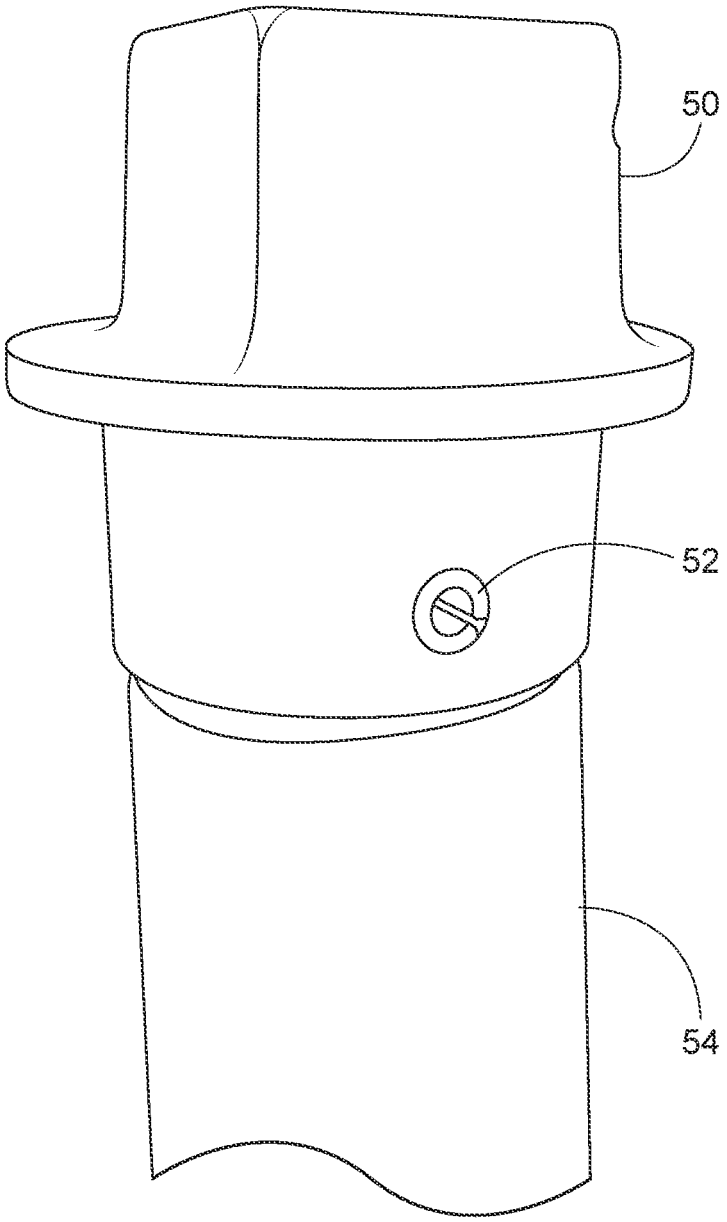
FIG. 3*a* is a side elevation view of a top nut.
Figure 3B:
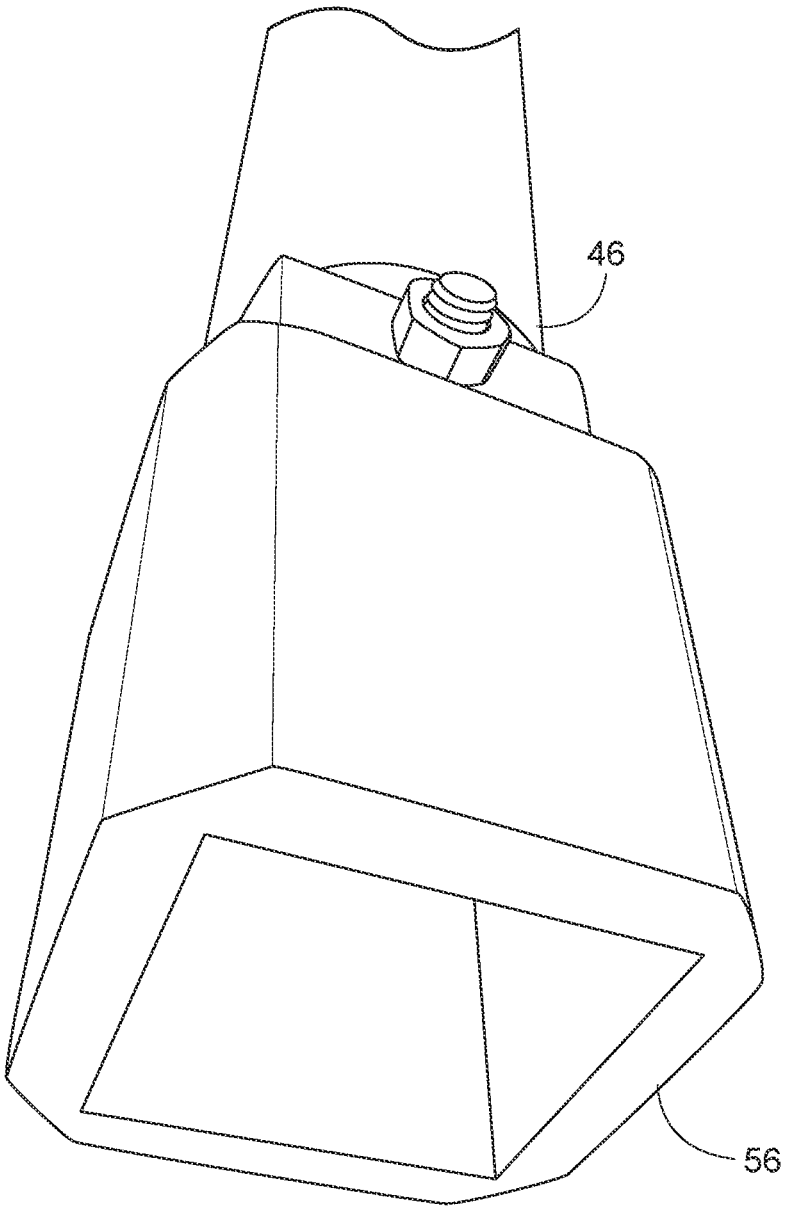
FIG. 3*b* is a perspective view of a bottom nut.

Turning now to FIGS. 2*a* to 3*b*, a method of assembly for an exemplary embodiment of the present application is illustrated. In FIG. 2*a*, a valve rod 40 is inserted into a spacer 42, with the pin hole 48 exposed. In FIG. 2*b*, a seal 44 is pressed over the end of the valve rod 40 (using a liquid Teflon™ if necessary as a lubricant) until the seal 44 abuts the end of the spacer 42. In FIG. 2*c*, the valve rod 40 with spacer 42 and seal 44 in inserted into an isolation sleeve 46, with the final assembly shown in FIG. 2*d* with the seal 44 and the isolation sleeve 46 flush and the end of the valve rod 40 protruding past the seal 44. FIG. 3*a* shows a top nut 50 installed on such an assembly, with a pin 52 passing through the hole to connect the top nut 50 to the valve rod (not shown), and abutting an isolation sleeve 54. FIG. 3*b* shows a bottom nut 56 connected to the assembly of FIG. 2*d*, abutting the lower end of the isolation sleeve 46.

Figure 4:
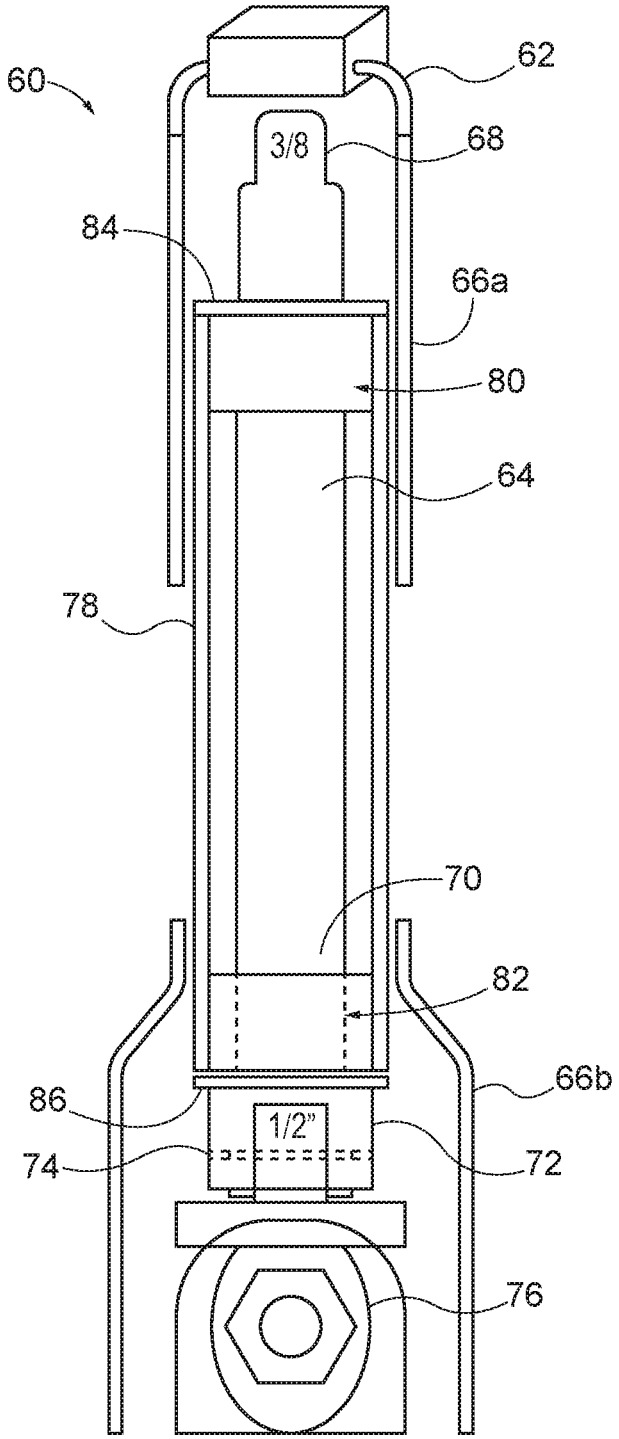
FIG. 4 is a side elevation view, partly in section, of an isolation assembly in accordance with a second exemplary embodiment of the present application.

While FIGS. 1*a* to 3*b* are directed to an embodiment for a main line valve rod, FIG. 4 illustrates an alternative embodiment of an assembly 60 for a curb valve rod 64. In this embodiment, the assembly 60 does not comprise a valve box, but the hole walls are instead constrained with only an upper sleeve 66*a* and a lower boot 66*b* (conventionally composed of high-density polyethylene) with a gap in between them, in a conventional arrangement, with a top cap 62 sealing the hole at surface. As can be seen, the lack of a valve box increases the exposure of the valve rod 64 to moisture and debris, and such holes commonly fill with dirt and mud and also are known to freeze up. Similarly to the main line assembly 10, the valve rod 64 has a top end 68 and a bottom end 70, with the bottom end 70 connected to a bottom nut 72 by means of a pin-hole arrangement 74, the bottom nut 72 engaging the valve 76 in a conventional manner so that rotation of the valve rod 64 causes actuation of the valve 76. The top end 68 of the valve rod 64, however, does not connect to a top nut, but instead is flattened so that a tool can be used to directly rotate the valve rod 64.

The valve rod 64, preferably composed of stainless steel, is housed within an isolation sleeve 78 which is preferably composed of high-density polyethylene. The upper portion of the isolation sleeve 78 is plugged with an upper seal 80, while the lower portion of the isolation sleeve 78 is plugged with a lower seal 82, the seals 80, 82 again preferably composed of polyethylene and held in place by a slip-fit or interference-fit arrangement with the sleeve 78 inner wall. As with the main line assembly 10, in assembly 60 the seals 80, 82 are provided with apertures through which the valve rod 64 passes. To protect the seals 80, 82, in this embodiment the seals 80, 82 are covered by plastic covers 84, 86 which also comprise apertures for passage of the valve rod 64. The combination of the isolation sleeve 78, seals, 80, 82 and covers 84, 86 provides an isolative environment for the valve rod 64. While the top end 68 of the valve rod 64 extends beyond the isolative environment of the isolation sleeve 78, the upper sleeve 66*a* provides some protection from moisture and debris as the inner wall of the upper sleeve 66*a* is in very close proximity with the outer wall of the isolation sleeve 78.

The foregoing is considered as illustrative only of the principles of the subject matter of the present application. The scope of the claims should not be limited by the exemplary embodiments set forth in the foregoing, but should be given the broadest interpretation consistent with the specification as a whole. It will therefore be appreciated by those skilled in the art that yet other modifications could be made to the provided subject matter without deviating from its spirit and scope as claimed.

What is claimed is:

1. An isolation apparatus for a subsurface valve rod, the valve rod configured to actuate a subsurface valve, the valve accessible by a hole extending downwardly from ground level toward the valve within which hole the valve rod is located, the valve rod comprising a top end and a bottom end, the bottom end of the valve rod connected to the valve via a bottom nut and the top end of the valve rod configured for engagement with a valve wrench via a top nut for rotation of the valve rod to actuate the valve, the isolation apparatus comprising:

an isolation sleeve;

an upper seal retained in an upper portion of the isolation sleeve;

a lower seal retained in a lower portion of the isolation sleeve; and the upper and lower seals provided with apertures therethrough, the apertures configured for receipt of the valve rod therein;

wherein the valve rod is configured such that, when the valve rod is received through the apertures, the top end of the valve rod extends above the upper seal and the bottom end of the valve rod extends below the lower seal;

wherein the isolation apparatus is configured such that, when the isolation apparatus is installed on the valve rod and the valve rod is connected to the valve via the bottom nut, the isolation sleeve and the lower seal abut the bottom nut; and wherein the isolation apparatus is configured such that, when the isolation apparatus is installed on the valve rod and the valve rod is connected to the top nut, the isolation sleeve and the upper seal abut the top nut.

2. The isolation apparatus of claim 1, further comprising:

a spacer located between and in contact with the upper and lower seals.

3. The isolation apparatus of claim 1, wherein:

the upper and lower seals are composed of polyethylene.

4. The isolation apparatus of claim 1, wherein:

the upper and lower seals are retained within the isolation sleeve by slip-fit engagement with an inner surface of the isolation sleeve.

5. The isolation apparatus of claim 4, wherein:

the slip-fit engagement is achieved by at least one barb on outer surfaces of each of the upper and lower seals.

6. The isolation apparatus of claim 1, wherein:

the isolation sleeve is composed of a material selected from the group consisting of polyvinyl chloride and high-density polyethylene.

7. The isolation apparatus of claim 2, wherein:

the spacer is composed of high-density polyethylene.

8. The isolation apparatus of claim 1, wherein:

the subsurface valve is on a water line.

9. The isolation apparatus of claim 1, wherein:

the subsurface valve is on a sewer line.

10. An actuation assembly for a subsurface valve, the valve accessible by a hole extending from ground level, the assembly comprising:

a valve rod located within the hole and comprising a top end and a bottom end, the top end of the valve rod connected to a top nut, the top nut configured for engagement by a valve wrench, the bottom end of the valve rod connected to a bottom nut, the bottom nut connected to the valve, such that rotation of the valve rod by the valve wrench actuates the valve;

an isolation sleeve;

an upper seal retained in an upper portion of the isolation sleeve; and a lower seal retained in a lower portion of the isolation sleeve;

wherein the upper and lower seals are provided with apertures therethrough, the valve rod is received through the apertures, the top end of the valve rod extends above the upper seal, and the bottom end of the valve rod extends below the lower seal;

wherein the isolation sleeve and the lower seal abut the bottom nut; and wherein the isolation sleeve and the upper seal abut the top nut.

11. The actuation assembly of claim 10, further comprising:

a spacer located between and in contact with the upper and lower seals.

12. The actuation assembly of claim 10, wherein:

the upper and lower seals are composed of polyethylene.

13. The actuation assembly of claim 10, wherein:

the upper and lower seals are retained within the isolation sleeve by slip-fit engagement with an inner surface of the isolation sleeve.

14. The actuation assembly of claim 13, wherein:

the slip-fit engagement is achieved by at least one barb on outer surfaces of each of the upper and lower seals.

15. The actuation assembly of claim 10, wherein:

the isolation sleeve is composed of a material selected from the group consisting of polyvinyl chloride and high-density polyethylene.

16. The actuation assembly of claim 11, wherein:

the spacer is composed of high-density polyethylene.

17. The actuation assembly of claim 10, wherein:

the subsurface valve is on a water line.

18. The actuation assembly of claim 10, wherein:

the subsurface valve is on a sewer line.

19. An actuation assembly for a subsurface valve, the valve accessible by a hole extending from ground level, the assembly comprising:

a valve rod located within the hole and comprising a top end and a bottom end, the top end of the valve rod configured for engagement by a valve wrench, the bottom end of the valve rod connected to a bottom nut, the bottom nut connected to the valve, such that rotation of the valve rod by the valve wrench actuates the valve;

an isolation sleeve;

an upper seal retained in an upper portion of the isolation sleeve; and a lower seal retained in a lower portion of the isolation sleeve;

wherein the upper and lower seals are provided with apertures therethrough, the valve rod is received through the apertures, the top end of the valve rod extends above the upper seal, and the bottom end of the valve rod extends below the lower seal; and wherein the isolation sleeve and the lower seal abut the bottom nut.

20. The actuation assembly of claim 19, wherein:

the upper and lower seals are composed of polyethylene.

21. The actuation assembly of claim 19, wherein:

the upper and lower seals are retained within the isolation sleeve by slip-fit engagement with an inner surface of the isolation sleeve.

22. The actuation assembly of claim 19, wherein:

the isolation sleeve is composed of a material selected from the group consisting of polyvinyl chloride and high-density polyethylene.

23. The actuation assembly of claim 19, wherein:

the subsurface valve is on a water line.

24. The actuation assembly of claim 19, wherein:

the subsurface valve is on a sewer line.

* * * * *